United States Patent [19]

Walter et al.

[11] 4,203,026

[45] May 13, 1980

[54] TEMPERATURE RESPONSIVE FLUID DELIVERY CONTROL DEVICE FOR A STEAM CURLING IRON

[75] Inventors: Henry J. Walter, Wilton; William E. Springer, Stratford, both of Conn.

[73] Assignee: Clairol Incorporated, New York, N.Y.

[21] Appl. No.: 931,719

[22] Filed: Aug. 7, 1978

Related U.S. Application Data

[63] Continuation of Ser. No. 768,670, Feb. 14, 1977, abandoned.

[51] Int. Cl.[2] ..... H05B 1/00; A45D 2/36; F22B 27/00; A45D 1/04

[52] U.S. Cl. ..... 219/222; 38/77.7; 122/40; 132/11 R; 132/37 R; 219/273; 239/136; 236/93 R; 251/11

[58] Field of Search ..... 219/271-276, 219/362, 222-226; 132/7, 9, 11 R, 37 R, 37 A; 122/40, 41; 38/69, 77-77.9; 68/222; 251/11; 239/132-137; 43/125-130; 236/93 R

[56] References Cited

U.S. PATENT DOCUMENTS

| | | | |
|---|---|---|---|
| 1,580,293 | 4/1926 | Fitzer | 219/273 |
| 1,691,244 | 11/1928 | Hussey | 219/273 X |
| 1,741,725 | 12/1929 | McKeown | 219/273 UX |
| 1,828,702 | 10/1931 | Foo | 219/272 X |
| 2,137,876 | 11/1938 | Hudson | 219/273 X |
| 2,299,110 | 10/1942 | Richards | 122/40 |
| 2,317,706 | 4/1943 | Woodman | 38/77.7 |
| 2,337,077 | 12/1943 | Woodman | 38/77.7 |
| 2,647,017 | 7/1953 | Coulliette | 251/11 X |
| 2,713,221 | 7/1955 | Smellie | 38/77.7 |
| 2,981,017 | 4/1961 | Tesmer et al. | 38/77.7 |
| 3,835,292 | 9/1974 | Walter et al. | 219/222 |
| 4,125,953 | 11/1978 | Colombo | 38/77.7 |

*Primary Examiner*—A. Bartis

*Attorney, Agent, or Firm*—Gerald S. Rosen; George A. Mentis

[57] ABSTRACT

A fluid delivery control device for regulating fluid delivery by a pump to the heated vaporization chamber of a steam curling iron through a fluid conduit provided with a spring biased valve in response to the temperature of a heating element in the chamber includes a bimetallic disc in the chamber having the property of changing its shape when heated to a temperature corresponding to the minimum temperature required of the heating element for vaporizing the fluid. A fluid delivery tube through which the fluid is delivered from conduit to the chamber has one end adjacent to the valve and the other end attached to the disc for movement therewith. When the chamber is below the minimum temperature, the disc pushes the one end of the tube against the valve to hold it closed and prevent delivery of fluid through the tube to the chamber. When the chamber is at or above the minimum temperature, the disc distorts and pulls the tube away from the valve, allowing the valve to be opened and fluid to be delivered through the tube to the chamber.

8 Claims, 8 Drawing Figures

HEATING ELEMENT
FUSE
THERMOSTAT

TEMPERATURE RESPONSIVE FLUID DELIVERY CONTROL DEVICE FOR A STEAM CURLING IRON

This is a continuation of application Ser. No. 768,670, filed Feb. 14, 1977 now abandoned.

BACKGROUND OF THE INVENTION

This invention relates to a fluid delivery control device for a steam emitting appliance, such as a steam curling iron. More particularly, it relates to a device for causing the opening and closing of a fluid delivery conduit between a reservoir and a vaporization chamber of an iron, depending upon the temperature attained by a heating element in the chamber.

One known steam curling iron is capable of projecting a measured amount of steam against a user's hair to promote its curling or setting. Such an iron includes a liquid reservoir, a heating chamber having a heating element, and a pump for delivering liquid from the reservoir into the chamber for vaporization. Additionally, means are provided therein for regulating the maximum temperature of the heating element and liquid being heated thereby. However, neither the above described iron nor any other known to the applicants include means, such as the device of this invention, for preventing delivery of liquid from the reservoir into the chamber until the heating element attains a desired minimum temperature. Thus, this device helps insure that steam emitted from the iron will essentially be within prescribed limits.

SUMMARY OF THE INVENTION

A fluid delivery control device for regulating fluid delivery through a valved conduit from a reservoir to a means for vaporizing the fluid, the device regulating fluid delivery in response to the temperature of the vaporization means. When the vaporization means has attained a sufficient temperature to vaporize the fluid, the control device allows fluid delivery thereto; otherwise, the control device prevents fluid delivery to the vaporizing means. One embodiment of the control device includes a bimetallic disc and a fluid delivery tube. The disc has the property of changing its shape when heated to a particular temperature, the temperature being the same as or corresponding to the minimum temperature required of the means for vaporizing the fluid. The fluid delivery tube, through which the fluid may be delivered to the vaporizing means, is fixedly attached to the disc and movable both in and out of contact with the valve, upon change of shape of the disc, to close and open the valve. The tube contacts the valve when the disc is in an unheated condition, pushing it against the valve seat thus closing the valve and stopping fluid from flowing through it and the fluid delivery tube into the heating chamber. When the disc is heated it changes shape, axially sliding the fluid delivery tube away from the valve thus allowing it to open and permit fluid to flow therethrough to the fluid delivery tube and through the tube to the heating chamber, where the fluid is vaporized.

DESCRIPTION OF THE INVENTION

Steam curling irons in which the device of this invention may be embodied are shown and described in U.S. Pat. No. 3,835,292, the disclosure of which is incorporated by reference herein.

Figures 1, 2:
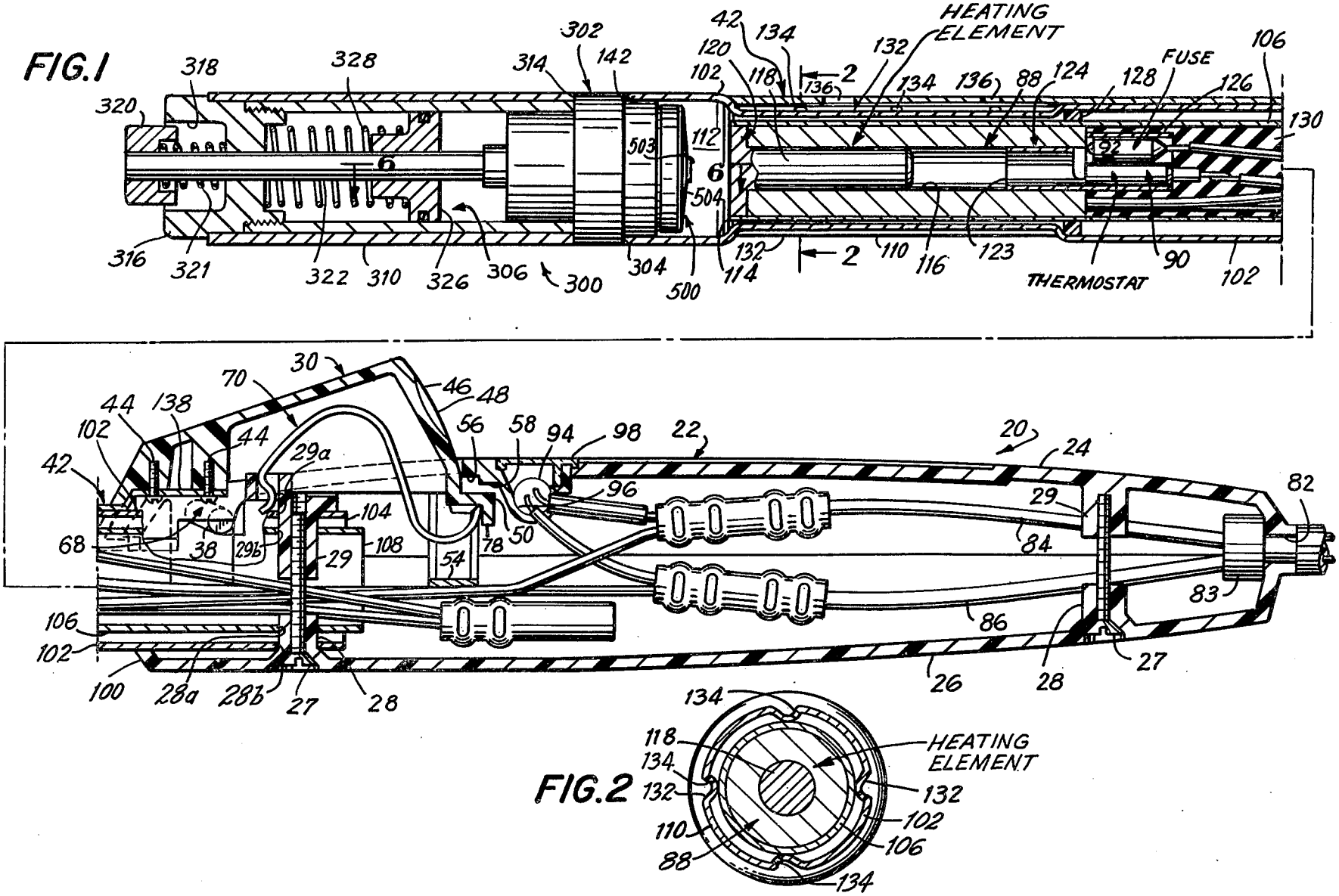
FIG. 1 is a longitudinal view of a steam curling iron in which one embodiment of the device of the present invention is shown, the iron being in section.
FIG. 2 is a sectional view taken along line 2—2 of FIG. 1.
Figure 3:
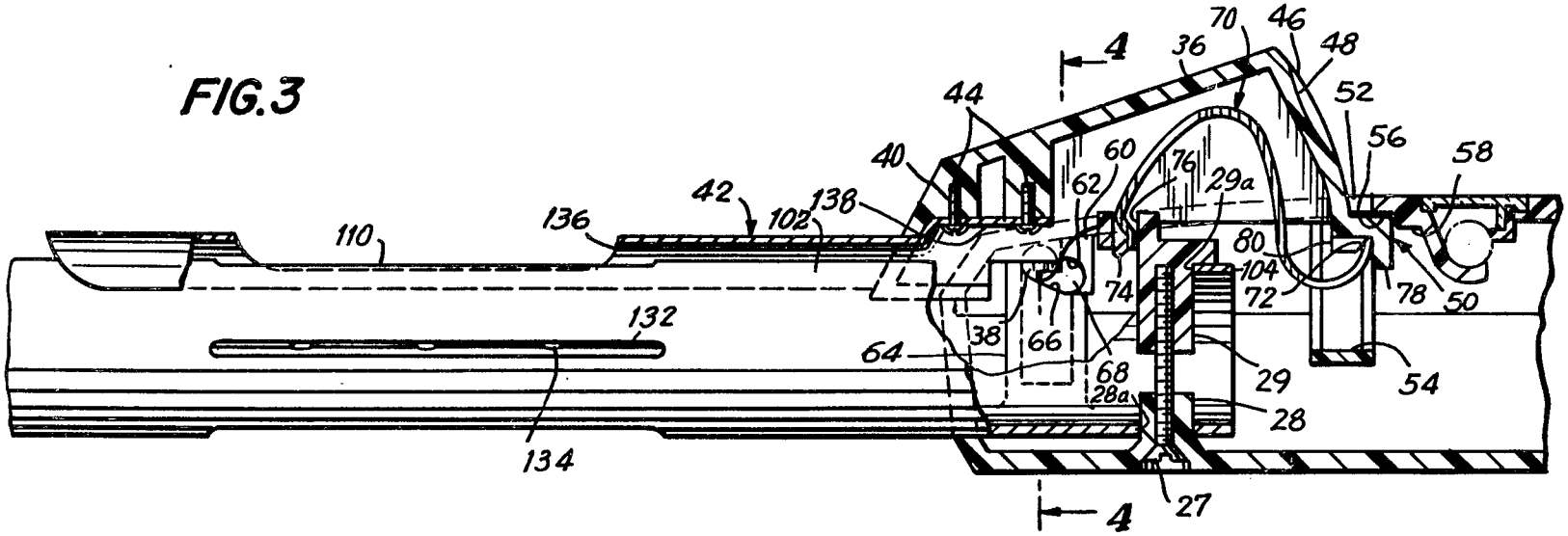
FIG. 3 is a broken away, longitudinal view, partly in section, of the steam curling iron of FIG. 1.
Figure 4:
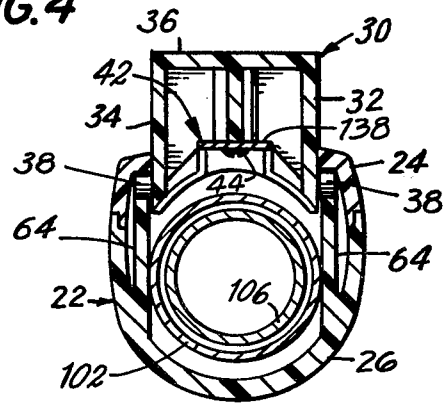
FIG. 4 is a sectional view taken along line 4—4 of FIG. 3.

A steam curling iron 20 embodying this fluid delivery control device is illustrated in FIG. 1. The iron includes a tubular housing 22 formed of an upper housing member 24 and a lower housing member 26 secured together by screws 27, which are received in cylindrical guides 28 in the lower housing member 26 and engage internally threaded bores in cylindrical guides 29 in the upper housing member 24. Housing 22 defines a handle grip and a button 30 is pivotally mounted in the housing for easy operation by hand grasping of housing 22. As best shown in FIG. 4, button 30 has parallel, flat side walls 32 and 34 extending from a top wall 36 and a cylindrical ear 38 protrudes transversely from the bottom of each side wall 32 and 34. Secured to the front end 40 of the top wall 36 by screws 44 is an elongate clip 42, as shown in FIG. 3. Top wall 36 slopes upwardly from front end 40 to to a rear wall 46, which has an arcuate recess 48, and terminates at a stepped end 50. Upper housing member 24 has an opening 52 receiving button 30, stepped end 50 of rear wall 46 extends between a stop 54 to limit opening pivotal movement of button 30, and a stepped ledge having surfaces 56 and 58 is formed in upper housing member 24.

Upper housing member 24 has a pair of side walls 60 with a recess 62 formed in each side wall. Each recess 62 has arcuate ends with a line connecting the centers of curvature thereof disposed at an angle to the longitudinal axis of steam curling iron 20. Similarly, lower housing member 26 has a pair of side walls 64, each of which has a recess 66 formed therein with arcuate ends aligned with the arcuate ends of recess 62. Recesses 62 and 66 cooperate to form channels 68 extending angularly away from the axis of the curling iron. Channels 68 have a sufficient width to slidably receive ears 38 of button 30, such that the button can be pivoted on ears 38 and moved away from the axis of the curling iron by applying a force to rear wall 46 in parallel with the axis of the curling iron, thereby causing ears 38 to ride up in the channels.

Figure 5:
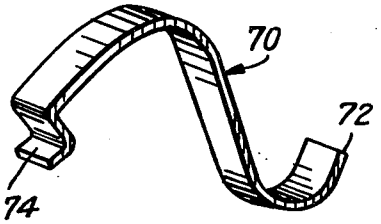
FIG. 5 is a perspective view of the clip spring of the steam curling iron of FIG. 1.

A flat spring 70 is provided, which has an S-configuration, as shown in FIG. 3, and is mounted to bias button 30 in a counterclockwise direction. Spring 70 has a curved end 72 anchored at the stepped end 50 of button 30 and an end 74 bent twice, as shown in FIG. 5, to be anchored in an opening 76 formed in upper housing member 24. Stepped end 50 of button 30 has a downwardly depending lip 78 which cooperates with a rib 80 to hold end 72 of spring 70 in place, such that spring 70 not only biases button 30 out of the housing 22, but also biases button 30 toward the rear of the housing to hold ears 38 resiliently in the lower rear ends of channels 68. Referring particularly to FIG. 1, housing 22 has an opening 82 in the rear end thereof receiveing a plug 83 carrying electrical wires 84 and 86, which are connected in series through a ceramic, resistance wire heating element 88, a thermostat 90, and a fusible link 92 with a neon lamp 94 connected in parallel therewith. Neon lamp 94 is held in a receptacle 96 at the top of upper housing member 24 adjacent button 30 and is covered by a colored lens 98, such that when electricity is supplied to steam curling iron 20, the lamp 94 will be energized and visible through lens 98.

At the front end of housing 22, lower housing member 26 has an inwardly turned lip 100 contacting an outer tubular member 102, which has holes **29*a* and 29*b* in a proximal end 104 thereof receiving the cylindrical guides 28 and 29 of the upper and lower members. An inner tubular member 106 similarly has holes 28*a* and 28*b* in a proximal end 108 for mounting of cylindrical guides 28 and 29 of housing 22. Outer tubular member 102 forms a tubular body for the curling iron and has a hair winding portion 110 surrounding a heating chamber 112. Inner tubular member 106 terminates at a distal end 114 of heating chamber 112 and supports thereat heating element 88, which has a cylindrical tubular configuration. Heating element 88 has a bore 116 therein mounting a shank 118 of a tip heater 120 having a head hermetically sealed to the distal end 114 of the inner tubular member 106 in any suitable manner, such as brazing. Tip heater 120 is made of a high heat conducting metal, such as copper, and shank 118 is in thermal contact with heating element 88 such that the head of the tip heater reaches a temperature closely approximating the temperature of the heating element, which is well in excess of 100° C. At the other end of bore 116, a small diameter leg 123 of a spring clip 124 is mounted in good mechanical contact with the inner diameter of the bore. Spring clip 124 has a large diameter leg 126 mounting the thermostat 90, which may be a conventional bimetal switch, and the fusible link 92. Spring clip 124 is preferably constructed of a spring metal, such as phosphor bronze or beryllium copper, in order to make good contact with heating element 88, thermostat 90 and fusible link 92 for maximum heat conduction. Inner tubular member 106 is spaced from outer tubular member 102 such that outer tubular member 102 is heated by radiation rather than conduction to permit operation of the heating element at higher temperatures required to generate steam and a seal is formed between the outer and inner tubular members by a gasket 128. The heater, fusible link and thermostat assembly is secured within tubular member 106 to seal the end of the heating element by a high temperature, silicone rubber 130**, which provides a water-tight assembly.

The hair winding portion 110 of the tubular body has a plurality of longitudinal axial grooves 132 formed therein, each of the grooves having apertures 134 disposed therealong, as best illustrated in FIG. 2. Grooves 134 are formed with side walls with the apertures disposed in the side walls such that vapors exit from heating chamber 112 through apertures 134 in a direction at an angle to the radial direction and almost tangential to prevent scorching of the scalp of a user. Grooves 132 permit distribution of vapors when hair is tightly wound around the hair winding portion 110. The outer tubular member 102 is preferably made of stainless steel or other metallic material treated to inhibit corrosion and the outer surface thereof is preferably coated with a friction reducing material, such as for example polytetrafluoroethylene.

Referring again to FIG. 3, elongate clip 42 extends along the tubular body and is curved in cross-section to make intimate contact therewith. Clip 42 has an elongated slot 136 in the central portion thereof to permit steam to reach successively wound layers of hair and clip 42 is preferably coated with a friction reducing material such as polytetrafluouroethylene.

Clip 42 also has a step 138 at the proximal end thereof secured to button 30 by screws 44. The clip is normally biased against the hair winding portion 110 of outer tubular member 102 and can be pivoted away from the hair winding portion by depressing button 30, while being movable away from the hair winding portion 110 in a direction transverse to the longitudinal axis thereof by sliding movement of the ears 38 of the button 30 in channels 68.

Referring again to FIG. 1, the iron further includes a device for delivering fluid to be vaporized to heater 120. The delivery device, generally indicated at 300, includes a fluid supply member 302 and a fluid delivery control device of the present invention, generally indicated at 500.

Figure 6:
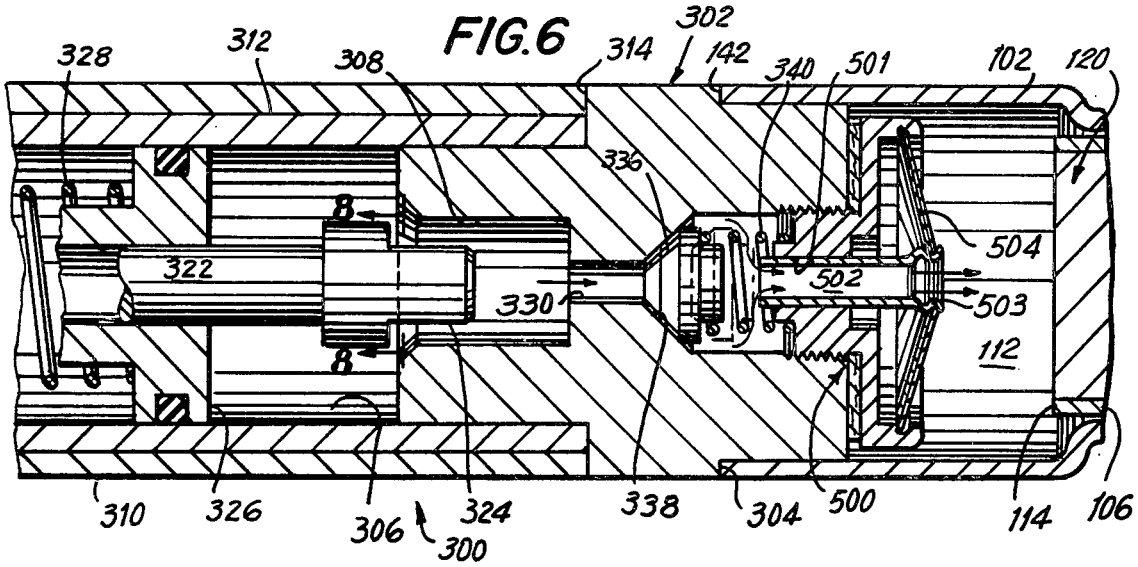
FIG. 6 is a sectional view taken along line 6—6 of FIG. 1 showing the device of the present invention in position for opening communication between the reservoir and heating chamber of the steam curling iron.
Figure 7:
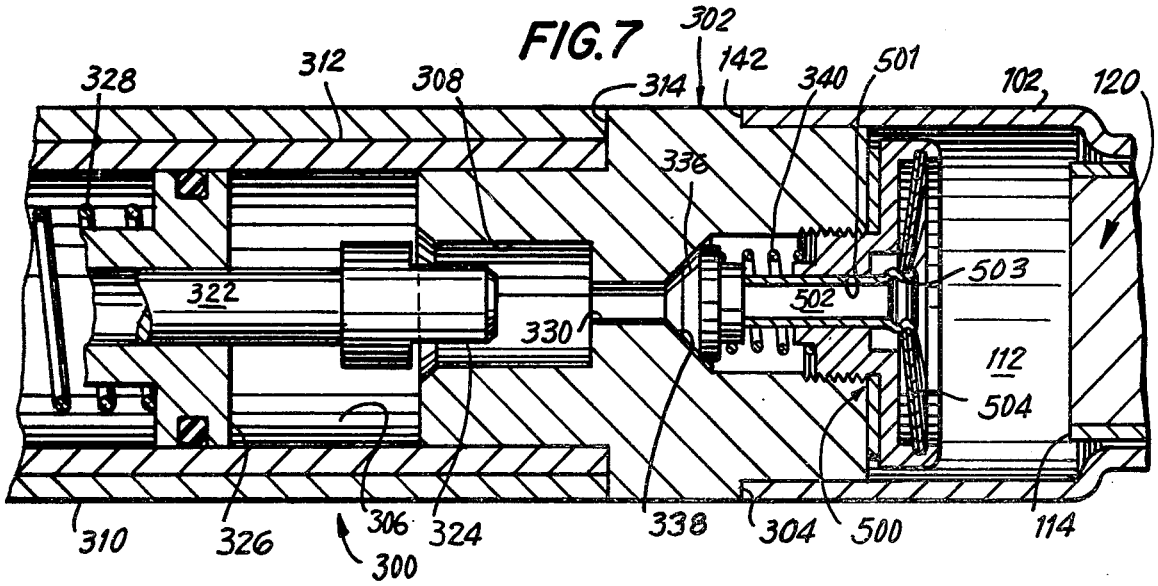
FIG. 7 is a view similar to FIG. 6 showing the device of the present invention in position for closing off communication between the reservoir and heating chamber of the steam curling iron.
Figure 8:
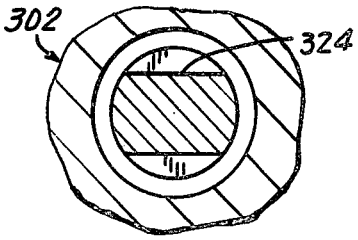
FIG. 8 is a sectional view taken along line 8—8 of FIG. 6.

As shown in FIGS. 6 and 7, supply member 302 is press fit on to the tubular body of the iron so that distal end 142 of member 102 abuts annular shoulder 304 formed in the periphery of member 302. A sleeve 310 surrounds a reservoir defining member 312 and is fixed to an annular shoulder 314 of supply member 302 and to member 312. Defined by supply member 302 and member 312 is a small diameter chamber 306 with a central cylindrical chamber 308 therein. Carried in chamber 306, as shown in FIG. 1, is a piston 326 slideable axially on a plunger 322 longitudinally oriented in delivery device 300. Biased away from piston 326 by a compressed, coiled spring 328 is a cap 316, which is threaded into member 312. At the end of plunger 322 furthest from heating chamber 112, head 320 of plunger 322 is positioned for movement inwardly into a recess 318 of cap 316 and is biased therefrom by a spring 321. Referring again to FIGS. 6 and 7, the other end of plunger 322 carries a piston 324, which is movable through chambers 306 and 308 to push fluid from the reservoirs through the supply member and into the heating chamber.

In communication with chamber 308 is a passage 330 in supply member 302. A valve 336 is resiliently biased against a valve seat 336 of passage 330 by a coiled spring 340, which spring is compressed between valve 336 and device 500.

The fluid delivery control device 500 is disposed in the iron between supply member 302 and heating chamber 112. This device has portions defining a bore 501 through which a fluid delivery tube 502 is inserted for axial movement in the bore. Tube 502 has one end adjacent valve 336 and the other end adjacent heating chamber 112, the latter end being provided with a flange portion 503. Mounted about flange portion 503 is a bimetallic disc 504.

It should be understood that the term "bimetallic disc" is intended to encompass bimetallic elements in general and not just those in the form of a disc. Other bimetallic elements, for example, are coils and strips. Most important whatever element is utilized, the metals of which the element is made should have rates of expansion and contraction, upon being heated and cooled, which cause the element to change its shape. Representative materials useful in the manufacture of the bimetallic disc of this invention include the materials mentioned above in connection with the bimetal switch of thermostat 90.

Upon being heated or cooled, disc 504 changes shape, thereby causing movement of tube 502. As shown in FIG. 6, when disc 504 has a generally convex shape, the end of tube 502 is spaced from valve 336. Thus, although the valve is resiliently biased against seat 338 by spring 340, the pressure of fluid thereagainst, if the dispensing device were operated, would allow fluid to be delivered into chamber 112 through tube 502. As shown in FIG. 7, when disc 504 has a generally concave shape, the end of tube 502 contacts valve 336 to push and hold the valve against its seat 338 and prevent movement thereof to its open position. Although the dispensing device may be operated to deliver fluid into passage 330, the pressure of the fluid would not be sufficient to open valve 336, thereby preventing the dispensing of fluid into heating chamber 112.

To utilize the temperature responsive character of disc 504 to regulate fluid delivery through passage 330 into chamber 112, the metals of which the disc is made are chosen in accordance with the particular temperature at which their rate of expansion or contraction causes a change in their shape. Generally, it will be desirable that the temperature at which disc 504 changes its shape will be the same as or in correspondence to the temperature required for fluid vaporization by heating element 88. Although a second heating means could be utilized to heat disc 504 to a particular temperature in correspondence to a measured temperature attained by element 88, the disc is preferably heated directly by heater 120, so that when the heater has reached the required vaporization temperature, disc 504 changes shape to that shown in FIG. 6 and allows fluid delivery into chamber 112.

To use the iron, fluid dispensing device 300 is first filled. Cap 316 is unscrewed from member 312 and the reservoir is filled with a fluid to be vaporized. Plunger 322 is then inserted in the reservoir and the cap is again screwed into member 312.

The iron is then heated to a desired temperature, preferably between 60° and 140° C. The temperature of heating element 88 is controlled by thermostat 90 in a conventional manner with fusible link 92 providing protection against damage to the hair if a high limit temperature is reached by the heating element, such as due to malfunction or failure of thermostat 90. Neon lamp 94 will be energized to signify to the user that the steam curling iron is being heated and, if desired, the neon lamp can be connected with the thermostat 90 or a suitable timing device such that it is energized only when steam curling iron 20 has reached the desired temperature.

With the steam curling iron at the desired temperature, a tress of hair to be set is wound around the hair winding portion 110 of tubular body 102. The end of the tress is clamped to hair winding portion 110 by depressing button 30 to pivot clip 42 away from the hair winding portion, placing the end of the tress under the clip, and then releasing the button to permit the bias from spring 70 to hold the hair against the hair winding portion. The position of the button and clip is limited by engagement of stepped end 50 of the button with surface 58 of the upper housing member 24. The entire tress is then wound around the steam curling iron over the clip 42 by rotation of the curling iron, it being appreciated that while the hair is being wound around the already heated curling iron 20, the moisture content of the hair is being reduced. After the hair has been completely wound about the hair winding portion, the user merely depresses head 320 into the recess 318 of the cap to move piston 324 in chamber 308 and discharge a predetermined quantity of the fluid to be vaporized through passage 330. Piston 324 forms with supply member 302 a pump for discharging a metered amount of fluid. The force from depression of the plunger overcomes the bias of spring 340 to move valve member 336 away from valve seat 338 and permit the fluid to be moved through fluid dispensing tube 502 into heating chamber 112, as shown in FIG. 6, for evaporation and application to the hair through tangential apertures 134 in the side walls of axial grooves 132. The vaporized fluid penetrates and plasticizes the hair wound around the steam curling iron and passes through the slot 136 in the clip 42 for access to the hair wound thereabove.

When the plunger is released, the force from spring 321 will return the plunger to its initial position, and the pressure from spring 328 will fill chamber 308 with fluid for the next application. It should be appreciated that the force from spring 328 is not sufficient to overcome the force from spring 340 to open the valve.

However, if in the above operation heater 120 does not attain the required temperature or the temperature of the heater decreases below that temperature, then disc 504 does not change its shape to that one shown in FIG. 6 and no fluid is delivered past valve 336 because of the contact of the end of tube 502 with valve 336 holds the valve against its seat 338 and prevents the force of the pumped fluid from opening the valve. Not until the heating element attains the correct temperature will tube 502 be moved out of contact with valve 336 to permit the valve to open to allow fluid delivery into chamber 112.

Therefore, although a user may operate plunger 322 to push fluid into passage 330, the iron will not operate to emit steam outside the prescribed limit.

It is contemplated that the operation of device 500 can be indicated to the user by a neon light, such as 94 above, or other conventional indicating means to show the user when the heating element is sufficiently heated and the iron is ready for operation.

Within a period of from 5 to 15 seconds, normally 10 seconds, the heat from the tubular body will evaporate the moisture applied to the hair to set the curl. The user then unwinds the tress of hair for one half turn and applies a force to the rear wall 46 of button 30, facilitated by gripping arcuate recess 48, to cause the ears 38 of the button to ride up in the channels 68 inclined to the axis of the tubular body such that the clip 42 will be moved transversely to the longitudinal axis of the tubular body to a position in parallel with the hair winding portion and spaced approximately 1/16" therefrom, as shown in FIG. 3. The stepped end 50 of the button 30 will now be moved to engage surface 56 of the upper housing member 24 to thereby place the button and clip in a stable position, and the wound tress of hair can now be easily, axially removed from the curling iron without interference from the clip 42.

From the above, it will be appreciated that the coaxial alignment of the fluid dispensing devices with the tubular body of the steam curling iron at one end thereof facilitates operation of the metering mechanism to supply a predetermined amount of vaporized fluid to the hair without interfering with axial removal of the hair after setting. Furthermore, the support for the elongate clip 42 to permit both pivotal and parallel movement thereof relative to the tubular body provides full utilization of the clip as a retainer to clamp the end of a tress of hair prior to winding about the steam curling iron without presenting an obstacle to axial removal of the hair after settting.

Inasmuch as the present invention is subject to many variations, modifications and changes in detail, it is intended that all matter described above or shown in the accompanying drawings be interpreted as illustrative and not in a limiting sense.

What is claimed is:

1. A steam emitting device comprising a fluid reservoir, a vaporization chamber, first means in said chamber for heating and vaporizing fluid in the chamber, second means for delivering fluid to be vaporized from the reservoir into the chamber, said second means comprising a fluid delivery conduit between the reservoir and chamber, a valve in the conduit, and means for selectively moving said valve between a first closed position preventing fluid flow through said conduit and a second open position allowing fluid flow therethrough and third means for regulating fluid delivery through the valve, the third means comprising first and second elements fixedly attached to one another, the first element being in heat exchange relationship to the vaporization chamber and having the property of changing its shape when heated to a particular temperature, the temperature being the same as or in correspondence to the minimum temperature required of the first means for vaporizing fluid in the chamber; the second element having a fluid delivery passage through which fluid may be delivered from the conduit and through the valve into the vaporization chamber and said second element being movable by the first element in and out of contact with the valve, upon change of shape of the first element due to its temperature in relation to said required minimum temperature; and said second element being moved into contact with the valve by the first element when the first element is below said minimum temperature thereby preventing movement of said valve from its first closed position to its second open position and being moved out of contact with the valve by the first element when the first element is at or above said minimum temperature, to allow said valve to be moved from its first closed position to its second open position so that fluid may flow from said reservoir through said conduit and the delivery passage of said second element into the vaporization chamber, so that the third means allows fluid to be delivered to the vaporization chamber only when the first means is at or above the required minimum temperature.

2. The device of claim 1 wherein the vaporization chamber is a heating chamber having, as the first means, a heating element therein.

3. The device of claim 1 wherein the second means further includes a pump for forcing fluid under pressure from said reservoir through said conduit.

4. The device of claim 1 wherein the first and second elements are, respectively, a bimetallic disc and a fluid delivery tube.

5. The device of claim 4 wherein the disc is made of two distinct layers of metal joined together, the metal of each layer having a different coefficient of expansion and upon being heated and cooled expanding and contracting to change the shape of the disc.

6. The device of claim 4 wherein the tube has a flange portion on which the disc is journaled.

7. The device of claim 4 wherein the vaporization chamber has apertures through which the vaporized fluid is emitted from the device.

8. A steam curling iron comprising a fluid reservoir, a vaporization chamber, a heating element for vaporizing fluid in the chamber, a pump associated with said reservoir for pumping fluid to be vaporized from the reservoir into the chamber, a fluid delivery conduit for delivering pumped fluid to the chamber, a valve in the conduit normally biased to a first closed position preventing delivery of fluid through the conduit to the chamber and being movable to a second open position by the pressure of the pumped fluid to allow delivery of the fluid to the chamber, a bimetallic disc in heat exchanging relationship to the chamber, the disc having the property of changing its shape when heated to a particular temperature, the temperature being the same as or in correspondence to the minimum temperature required of the heating element for vaporizing the fluid, a fluid delivery tube, the tube having a flange portion about which the disc is fixed and said tube being movable by the disc in and out of contact with the valve, upon change of shape of the disc wherein when the disc is below said minimum temperature said tube is moved into contact with said valve to prevent movement of the valve from its first closed position to its second open position, and when the disc is at or above said minimum temperature said tube is moved out of contact with said valve by the change in shape of said disc thereby allowing the valve to be moved by the pressure of its second open position so that the fluid may flow from the reservoir through the conduit and the fluid delivery tube into the chamber whereby the bimetallic disc allows fluid to be delivered to the vaporization chamber only when the vaporization chamber is at or above the required minimum temperature.

* * * * *